US007806658B2

(12) United States Patent
Liang et al.

(10) Patent No.: US 7,806,658 B2
(45) Date of Patent: Oct. 5, 2010

(54) TURBINE AIRFOIL COOLING SYSTEM WITH SPANWISE EQUALIZER RIB

(75) Inventors: George Liang, Palm City, FL (US); Xubin Gu, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 982 days.

(21) Appl. No.: 11/586,455

(22) Filed: Oct. 25, 2006

(65) Prior Publication Data

US 2008/0101961 A1 May 1, 2008

(51) Int. Cl.
*F01D 5/18* (2006.01)

(52) U.S. Cl. ..... 416/97 R

(58) Field of Classification Search ..... 415/115, 415/116; 416/92, 96 R, 96 A, 97 R, 90 R
See application file for complete search history.

(56) References Cited

U.S. PATENT DOCUMENTS 4,474,532 A * 10/1984 Pazder ..... 416/97 R
4,753,575 A * 6/1988 Levengood et al. ..... 416/97 R
5,340,274 A 8/1994 Cunha
5,342,172 A 8/1994 Coudray et al.
5,403,159 A * 4/1995 Green et al. ..... 416/97 R
5,496,151 A 3/1996 Coudray et al.
5,779,437 A 7/1998 Abdel-Messeh et al.
5,813,836 A 9/1998 Starkweather
5,827,045 A 10/1998 Beeck
6,099,251 A 8/2000 LaFleur
6,164,912 A 12/2000 Tabbita et al.
6,210,112 B1 4/2001 Tabbita et al.
6,241,469 B1 6/2001 Beeck et al.
6,287,075 B1 9/2001 Kercher
6,629,817 B2 10/2003 Shelton et al.
6,837,683 B2 1/2005 Dailey
6,955,522 B2 10/2005 Cunha et al.
6,997,676 B2 2/2006 Koshoffer

* cited by examiner

*Primary Examiner*—Christopher Verdier

(57) ABSTRACT

A cooling system for a turbine airfoil of a turbine engine having an inflow mid-chord feed channel and a trailing edge feed channel that are separated by an equalizer rib having a plurality of supply holes. The supply holes enable cooling fluids to be supplied to the trailing edge from the mid-chord feed channel to satisfy the cooling requirements of the entire trailing edge, which is greater than the mid-chord region. A crossover hole may be positioned in the equalizer rib at the tip section to enable the cooling fluids to pass between the mid-chord feed channel and a trailing edge feed channel. The crossover hole may enable cooling fluids to pass from the trailing edge feed channel into the mid-chord feed channel along the tip section to reduce stagnation in the outboard turn of the mid-chord serpentine channel.

20 Claims, 11 Drawing Sheets

TURBINE AIRFOIL COOLING SYSTEM WITH SPANWISE EQUALIZER RIB

FIELD OF THE INVENTION

This invention is directed generally to turbine airfoils, and more particularly to cooling systems in hollow turbine airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion having a platform at one end and an elongated portion forming a blade that extends outwardly from the platform coupled to the root portion. The blade is ordinarily composed of a tip opposite the root section, a leading edge, and a trailing edge. The inner aspects of most turbine blades typically contain an intricate maze of cooling channels forming a cooling system. The cooling channels in a blade receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade. Thus, a need exists for a cooling system capable of providing sufficient cooling to turbine airfoils.

One particular conventional cooling system is shown in FIGS. 1-3. This system includes a mid-chord serpentine cooling channel and a trailing edge cooling circuit that are separated from each other by a continuous rib. The mid-chord serpentine cooling channel may bleed off cooling fluids through a tip section exhaust channel that extends to the trailing edge at the tip section because the mid-chord region normally experiences a lower heat load than the rest of the airfoil. The tip section exhaust channel does not receive any cooling fluids from the trailing edge cooling circuit. By bleeding off cooling air from the mid-chord region, the tip section exhaust channel at the tip flag yields a low mass flux and a low cooling flow at a large flow area that causes a low internal heat transfer coefficient, which is insufficient to provide proper cooling for that region. Subsequently, overheating occurs at the blade tip flag location proximate to the trailing edge that is potentially damaging to the turbine blade. Thus, a need exists for a turbine blade with an improved cooling system that overcomes these shortcomings.

SUMMARY OF THE INVENTION

This invention is directed to a turbine airfoil cooling system for a turbine airfoil used in turbine engines. In particular, the cooling system includes a mid-chord feed channel extending in a direction from a root to a tip section of the turbine blade and a trailing edge feed channel extending in the direction from the root to the tip section and positioned adjacent to the at least one mid-chord feed channel. The mid-chord feed channel and the trailing edge feed channel may be separated by an equalizer rib separating the at least one mid-chord feed channel from the at least one trailing edge feed channel. The equalizer rib may include a plurality of cooling fluid supply holes that place the mid-chord feed channel in fluid communication with the trailing edge feed channel. The cooling fluid supply holes may be sized to control the flow of cooling fluids across the equalizer rib. In at least one embodiment, the cooling fluid holes may have a length to width ratio of between about 5 to 1 and about 2 to 1, and more particularly about 3.5 to 1. The cooling fluid holes may or may not be equally spaced from a root of the airfoil to a tip of the airfoil.

The equalizer rib may also include a crossover hole positioned at the tip section of the generally elongated, hollow airfoil for placing the at least one mid-chord feed channel in fluid communication with the at least one trailing edge feed channel at the tip section of the blade. The crossover hole permits cooling fluids to flow back and forth from the mid-chord feed channel to the trailing edge feed channel and vice versa. The cooling fluids flowing through the crossover hole into the mid-chord feed channel reduce stagnation in the turn in the mid-chord serpentine cooling channel, thereby reducing the thermal gradient in the mid-chord region proximate to the tip.

The cooling system may also include a trailing edge tip exhaust channel in fluid communication with the crossover hole and with one or more trailing edge tip exhaust orifices in the trailing edge for exhausting cooling fluids from the trailing edge. The trailing edge tip exhaust channel may be open to the trailing edge cooling channel. The trailing edge tip exhaust channel may receive cooling fluids from the mid-chord feed channel, the trailing edge feed channel, and from other trailing edge cooling channels. Such a configuration reduces hot spots that tend to develop at the tip section and the trailing edge.

The cooling system may also include a plurality of trip strips positioned in the cooling channels. In at least one embodiment, the mid-chord feed channel and the trailing edge feed channel may each include a plurality of trip strips. The trip strips in the mid-chord feed channel may be aligned with trip strips in the trailing edge feed channel and may be parallel to each other. In another embodiment, the trip strips in the mid-chord feed channel may be aligned with trip strips in the trailing edge feed channel, and the trip strips in the trailing edge feed channel may be nonparallel with the trip strips in the mid-chord feed channel. In other words, the upstream ends of the trips strips in the trailing edge feed channel may be aligned with the trip strips in the mid-chord feed channel, but the remaining portions of the trip strips in the trailing edge feed channel may be positioned at an acute angle relative to a longitudinal axis of the trip strips in the mid-chord feed channel. The equalizer rib enhances the cooling action of the trip strips because the equalizer rib disrupts the vortices flowing toward the trailing edge along the trip strip and enables formation of new vortices to form along the trip strip in the trailing edge feed channel. Formation of the new vortices increases the cooling capacity of the cooling system by disrupting the boundary layer.

During use, cooling fluids may be received into the cooling system from a cooling fluid supply through the root. The cooling fluids may flow into the mid-chord feed channel and the trailing edge feed channel. The cooling fluid flow into the mid-chord feed channel and the trailing edge feed channel may be approximately equal. The cooling fluid flow demand for the airfoil trailing edge is generally much higher than the blade mid-chord region and thus, the cooling fluid is continuously bleed off from the trailing edge feed channel. Cooling fluids may flow from the mid-chord feed channel to the trailing edge feed channel to replenish the trailing edge feed channel to maintain an even cooling fluid flow distribution and pressure within both feed channels. The replenishment cooling fluids may flow through the supply holes in the equalizer rib.

At the upper mid-chord feed channel and the trailing edge feed channel, collectively referred to as a hybrid flow channel, the cooling fluid flow demand in the trailing edge region is less than the mid-chord region, and thus, the cooling fluids flow from the trailing edge feed channel to the mid-chord feed channel through the supply holes. The cooling fluids therefore replenish the mid-chord feed channel in this region.

The cooling fluids flowing into the turbine blade tip section from the trailing edge feed channel impinge on a backside of the tip section. The spent cooling fluids are then discharged through the tip cooling orifice, the crossover hole, and the trailing edge tip exhaust orifice. The cooling fluid flowing through the crossover hole flows into the turn in the mid-chord serpentine channel and eliminates the tip corner flow recirculation. The cooling fluid then flows along the tip section to cool the outer wall, impinges onto the forward corner of the blade tip section before merging with the cooling fluid flowing from the mid-chord feed channel in the inboard serpentine flow channel.

An advantage of this invention is that equalizer rib yields a lower cooling fluid flow consumption than the conventional tip flag and dead end trailing edge feed channel.

Another advantage of this invention is that the equalizer rib eliminates hot spots at the blade tip section.

Yet another advantage of this invention is that the equalizer rib provides additional stiffness for the cooling channel, thereby eliminating the possibility of the airfoil suction side bulging.

Another advantage of this invention is that equalizer rib provides a uniform Mach number, cooling flow, and pressure distribution for the hybrid concurrent flow channel.

Still another advantage of this invention is that the equalizer rib induces additional impingement cooling to the blade tip section, thus enhancing the cooling capacity of the tip section.

Another advantage of this invention is that equalizer rib enhances the blade tip turn region cooling and flow distribution, thereby lowering the tip turn pressure loss and yielding a higher back flow margin for the forward flowing serpentine circuit.

Yet another advantage of this invention is that the equalizer rib redistributes a portion of the mid-chord serpentine flow to the upper section of the tip turn and creates additional entrance area for the blade tip turn, thereby reducing the cooling air mass flux coming into the blade tip turn and lowers the turn loss.

Another advantage of this invention is that the equalizer rib divides the mid-chord feed channel and the trailing edge feed channel into two concurrent channels. The equalizer rib enables there to be two leading edges of a trip strip extending through the mid-chord and trailing edge feed channels. This configurations enables there to be two separate vortices formed by trip strips rather than only a single vortex with diminished cooling capabilities that results in the prior art due to a boundary layer propagating the length of the trip strip and reducing the overall heat transfer augmentation for the cooling channel.

Still another advantage of this invention is that the trip strips in the trailing edge feed channel can be aligned or staggered relative to the trip strips in the mid-chord feed channel. In addition, the trip strips in the trailing edge feed channel may be nonparallel to the trip strips in the mid-chord feed channel to customize the cooling fluid flow in each of the channels based on the external heat load.

Another advantage of this invention is that the supply holes in the equalizer rib may be different sizes for controlling the redistribution of cooling fluids spanwise between the mid-chord and trailing edge feed channels. The supply holes may also induce shear mixing effect to a side of the through flow channel and generate higher channel turbulent mixing level, thereby enhancing cooling channel potential core flow heat transfer and overall cooling channel performance.

Yet another advantage of this invention is that the equalizer breaks the vortex flow of cooling fluids, thereby increasing the internal heat transfer as compared with traditional long trip strips.

Another advantage of this invention is that the equalizer rib provides a higher overall airfoil internal convective cooling enhancement with a reduction in blade cooling flow demand that correlates with better turbine performance.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 6:
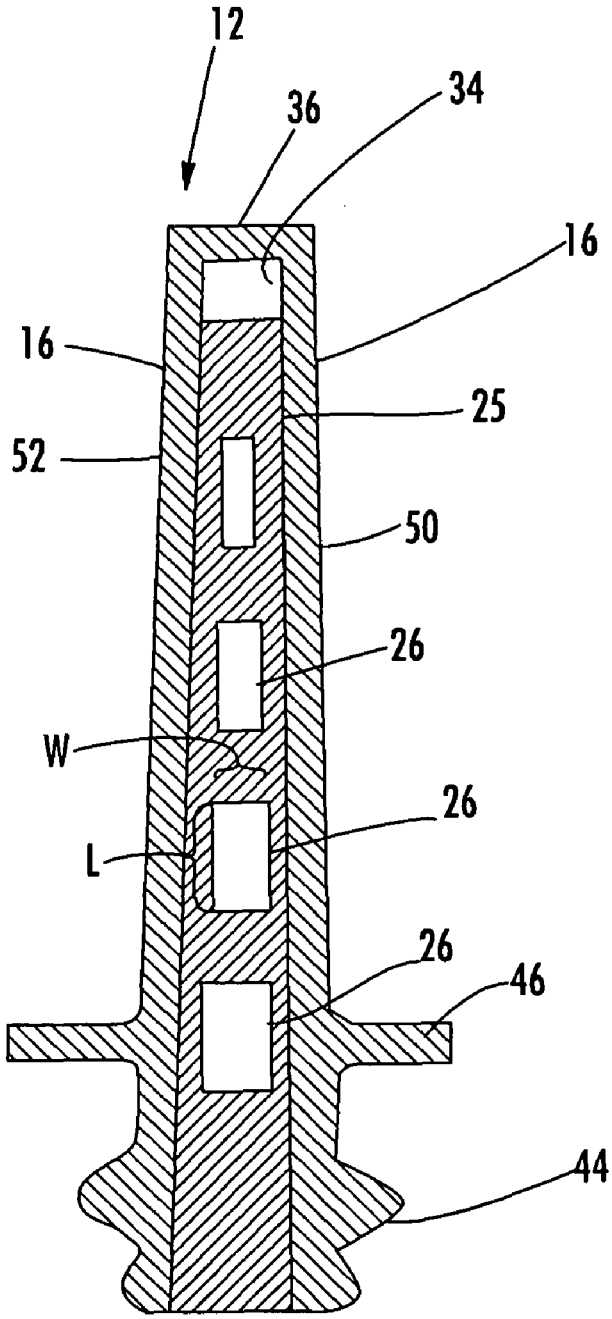
FIG. 6 is a cross-sectional view of the turbine airfoil taken along line 6-6 in FIG. 4.

As shown in FIGS. 4-11, this invention is directed to a turbine airfoil cooling system 10 for a turbine airfoil 12 used in turbine engines. In particular, the turbine airfoil cooling system 10 includes a plurality of internal cavities 14, as shown in FIG. 6, positioned between outer walls 16 of the turbine airfoil 12. The cooling system 10 may include a mid-chord serpentine channel 18 formed in part by a mid-chord feed channel 20. The cooling system 10 may also include a trailing edge cooling channel 22 including a trailing edge feed channel 24. The mid-chord feed channel 20 and the trailing edge cooling channel 22 may be separated by an equalizer rib 25 that includes a plurality of supply holes 26. The supply holes 26 enable cooling fluids to flow between the mid-chord and trailing edge regions 28, 30 to equalize the pressure and to enhance heat removal in the trailing edge region 30. The cooling system 10 may also include a trailing edge tip exhaust channel 32 in fluid communication with a crossover hole 34 in the equalizer rib 25 at the tip section 36 of the airfoil 12 and with at least one trailing edge tip exhaust orifice 38 in the trailing edge 40 for exhausting cooling fluids from the trailing edge 40. The cooling system 10 may also include a tip cooling orifice 64 aligned with the trailing edge feed channel 24 and in fluid communication with the trailing edge tip exhaust channel 32. The cooling system 10 enhances cooling at the tip section 36 while making more efficient use of the cooling fluids in the mid-chord region 28 and trailing edge region 30.

As shown in FIG. 6, the turbine airfoil 12 may be formed from a generally elongated, hollow airfoil 42 coupled to a root 44 at the platform 46. The turbine airfoil 12 may be formed from conventional metals or other acceptable materials. The generally elongated airfoil 42 may extend from the root 44 to the tip section 36 and include a leading edge 48 and the trailing edge 40. The root 44 may be configured to be attached to a disc. The generally elongated airfoil 42 may have an outer wall 16 adapted for use, for example, in a first stage of an axial flow turbine engine. Outer wall 16 may form a generally concave shaped portion forming pressure side 50 and may form a generally convex shaped portion forming suction side 52. The cooling system 10 may also include one or more leading edge cooling channels 54 extending along the leading edge 48 and feed with cooling fluids through a leading edge feed channel 56. The leading edge feed channel 56 may receive cooling fluids from the root 44 of the elongated airfoil 42.

Figure 1:
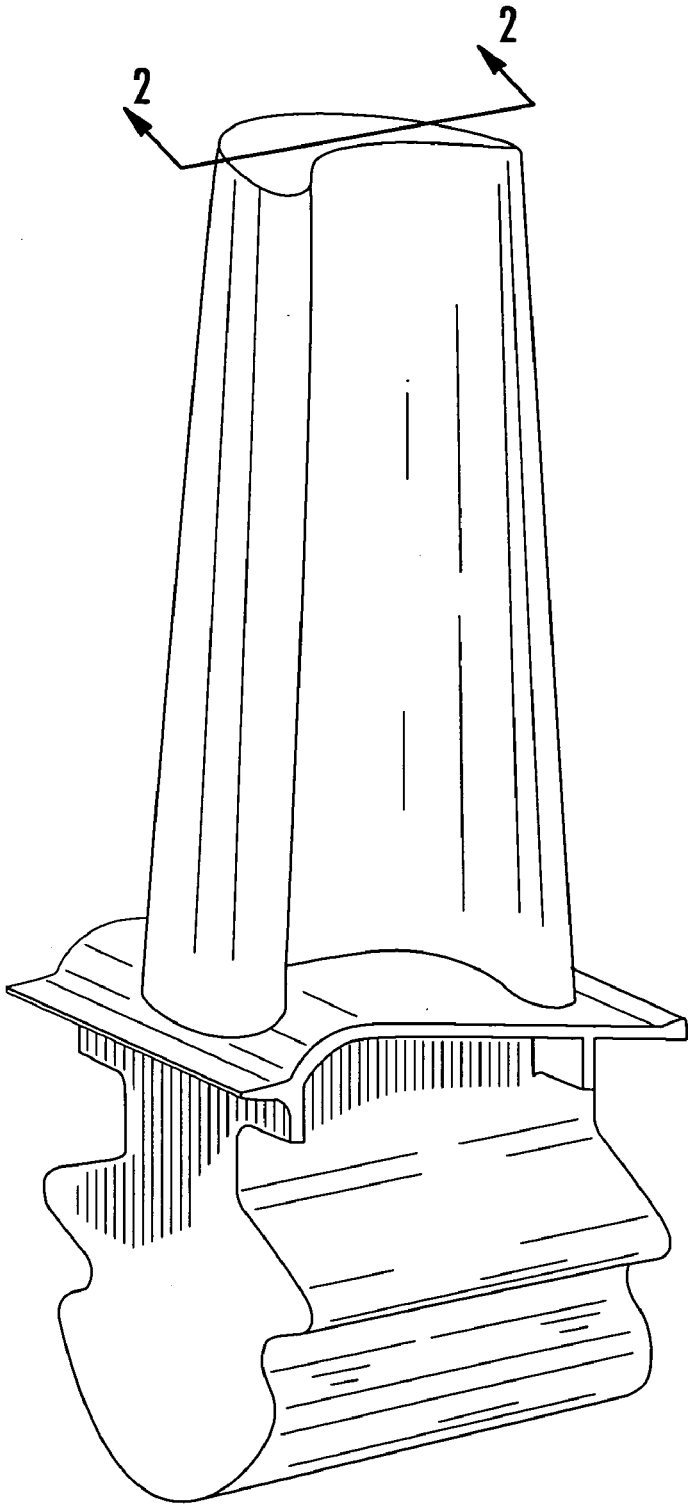
FIG. 1 (PRIOR ART)
FIG. 1 is a perspective view of a conventional turbine airfoil.
Figure 2:
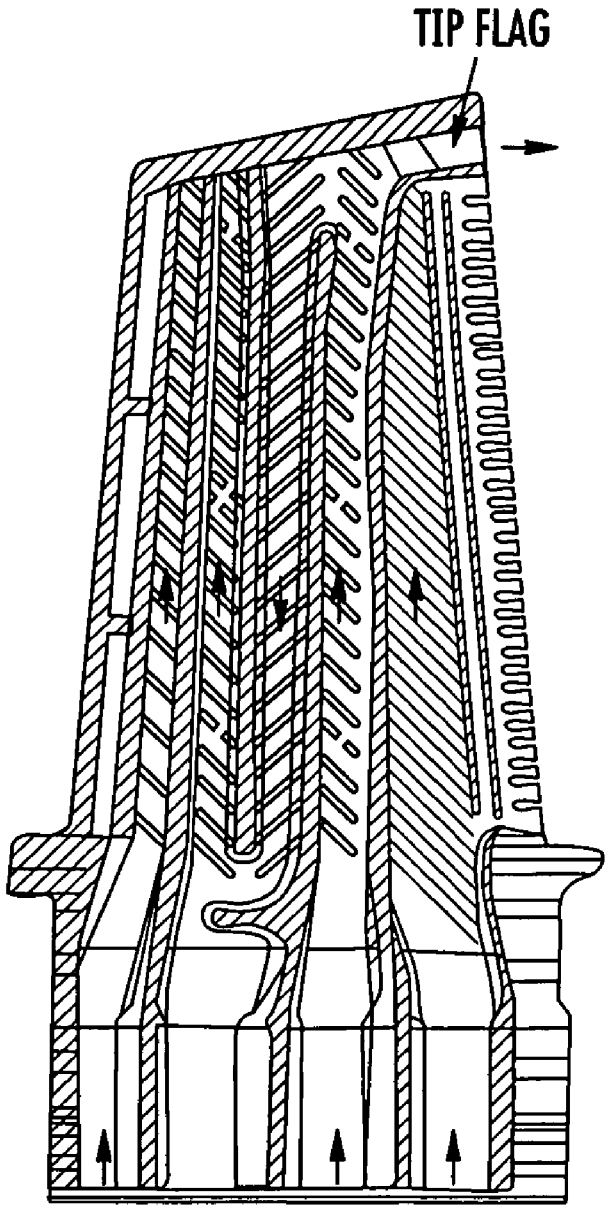
FIG. 2 (PRIOR ART)
FIG. 2 is a filleted cross-sectional view of the turbine airfoil shown in FIG. 1 taken along line 2-2.
Figure 3:
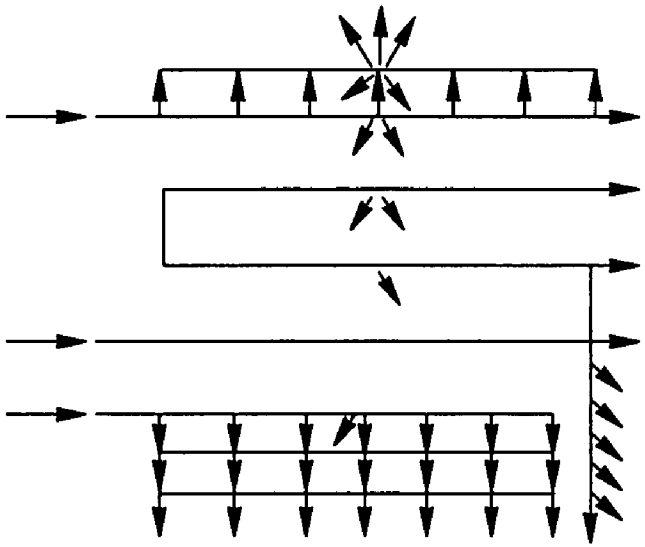
FIG. 3 (PRIOR ART)
FIG. 3 is a schematic diagram of the fluid flow through the cooling system shown in FIG. 2.
Figure 4:
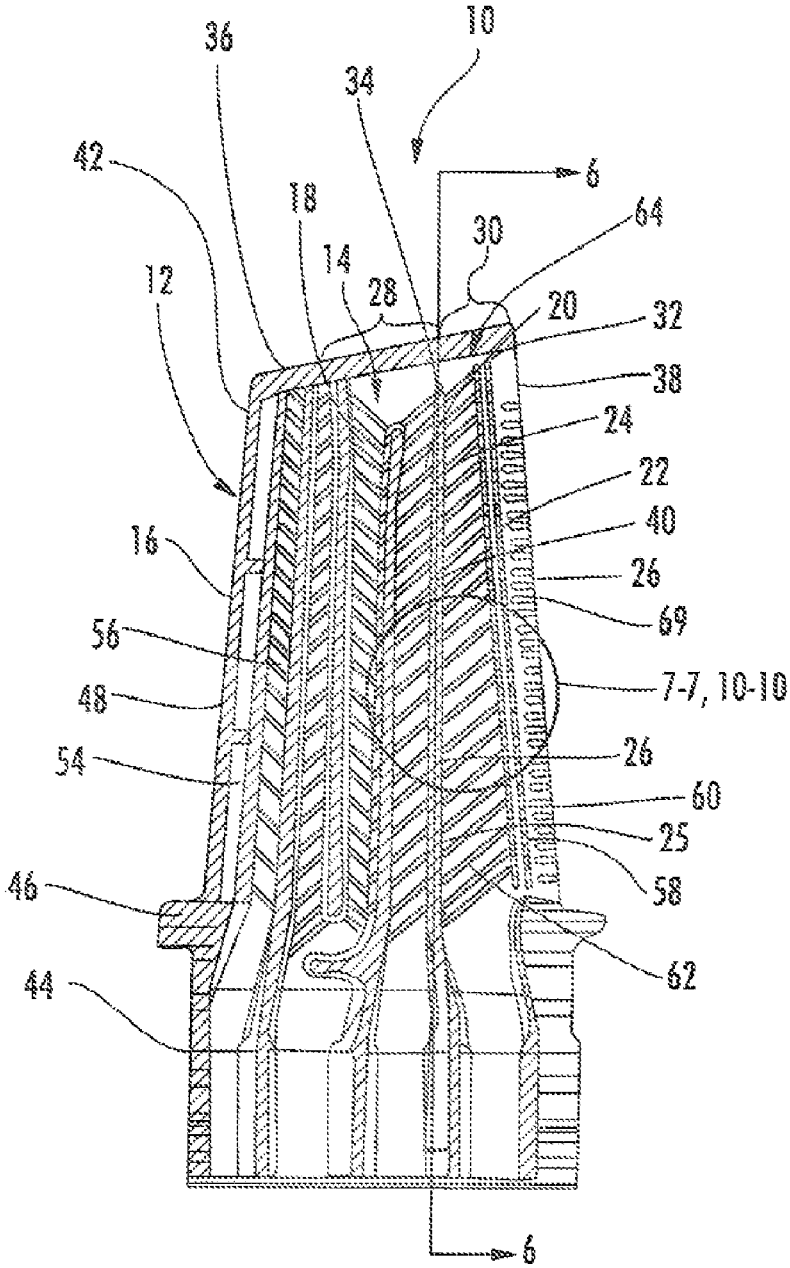
FIG. 4 is a filleted cross-sectional view of a turbine airfoil having aspects of this invention.
Figure 5:
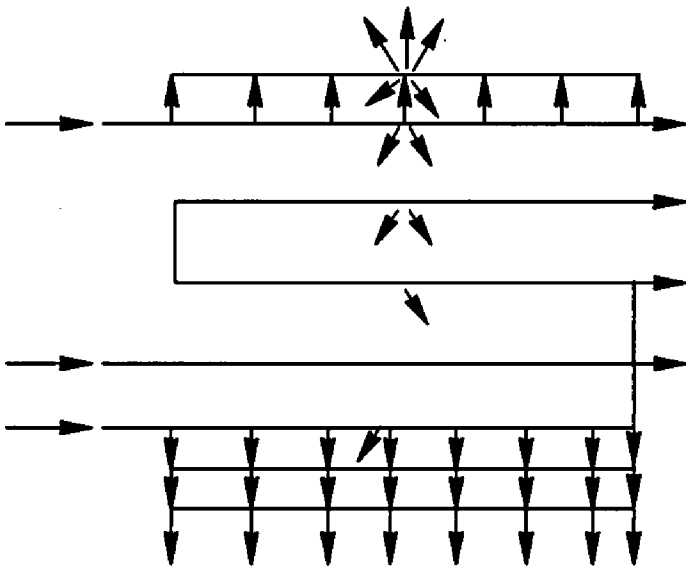
FIG. 5 is a schematic diagram of the fluid flow through the cooling system shown in FIG. 4.
Figure 11:
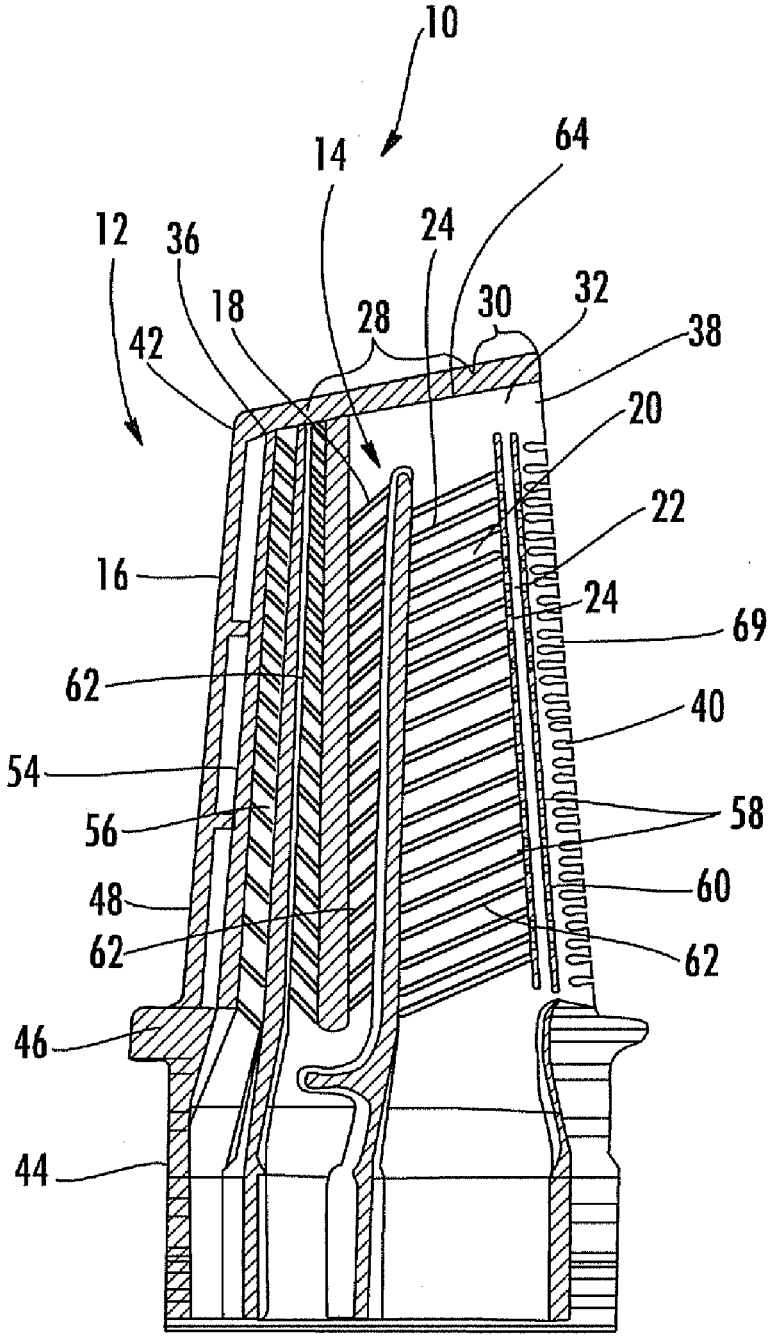
FIG. 11 is a filleted cross-sectional view of a turbine airfoil with a cooling system having an alternative configuration with aspects of this invention.

As shown in FIG. 4, the cooling system 10 may include a mid-chord serpentine channel 18. The mid-chord serpentine channel 18 may be positioned in the mid-chord region 28 of the elongated airfoil 42. The serpentine cooling channel 18 may have two or more legs, such as three legs, and may have any appropriate configuration. As shown in FIG. 4, the serpentine cooling channel 18 may be separated from the trailing edge feed channel 24 with an equalizer rib 25. However, in one embodiment, as shown in FIG. 11, the serpentine cooling channel 18 is not separated from the trailing edge feed channel 24 with an equalizer rib 25.

The equalizer rib 25 may extend in a direction from the root 44 toward the tip section 36. The equalizer rib 25 may also extend from the pressure side 50 to the suction side 52. In at least one embodiment, the equalizer rib 25 may extend generally spanwise from the root 44 to the tip section 36. The equalizer rib 25 may include a plurality of supply holes 26 positioned along the length of the equalizer rib. 25. The supply holes 26 may or may not be positioned equidistant from each other. The supply holes 26 may be sized to control the flow of fluids across the equalizer rib 25. For instance, the supply holes 26 may have a length to width ratio of between about 2 to 1 and about 5 to 1. In particular, the supply holes 26 may have a length to width ratio of about 3.5 to 1. Such a configuration provides adequate flow of cooling fluids from the mid-chord feed channel 20 to the trailing edge feed channel 24 while limiting stresses in the equalizer rib 25. The ratios of length to width may be larger at the tip section 36 than those supply holes 26 proximate to the root 44 because the thickness of the airfoil 42 at the root is greater than the thickness at the tip section 36. As a result, the supply holes 26 have a greater width proximate to the root 44 than at the tip section 36.

The cooling system 10 may also include a crossover hole 34 positioned at the tip section 36 and protruding through the equalizer rib 25 to place the mid-chord feed channel 20 in fluid communication with the trailing edge feed channel 24. As shown in FIG. 6, the crossover hole 34 may extend from the pressure side 50 to the suction side 52. The crossover hole 34 may be in fluid communication with a trailing edge tip exhaust channel 32. The trailing edge tip exhaust channel 32 may extend from the equalizer rib 25 to a trailing edge tip exhaust orifice in the trailing edge 40. The trailing edge tip exhaust channel 32 may be bounded by the pressure and suction sides 50, 52, and the tip section 36 and open to the trailing edge region 30 to receive cooling fluids.

The trailing edge region 30 may include one or more impingement ribs 58 extending generally spanwise. The impingement ribs 58 may include a plurality of impingement orifices 60. The impingement orifices 60 may or may not be offset in a spanwise direction from impingement orifices 60 in adjacent rows of impingement ribs 58. The impingement orifices 60 may be sized to control fluid flow to the trailing edge orifices 69.

Figure 7:
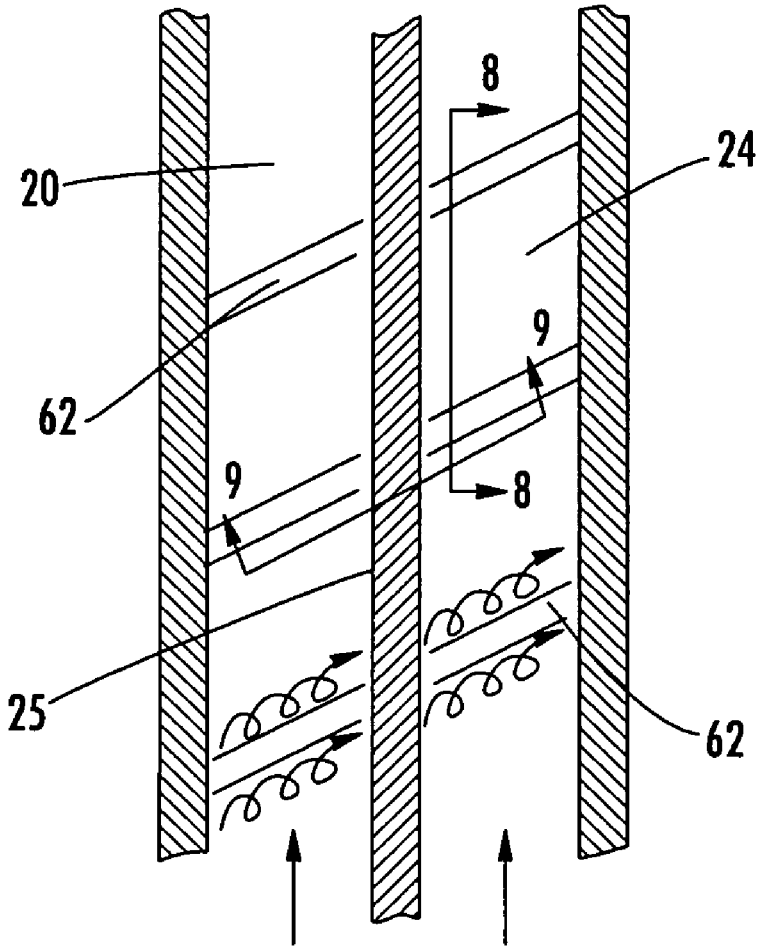
FIG. 7 is a detailed view of the mid-chord feed channel and the trailing edge feed channel taken at line 7-7 in FIG. 4.
Figure 8:
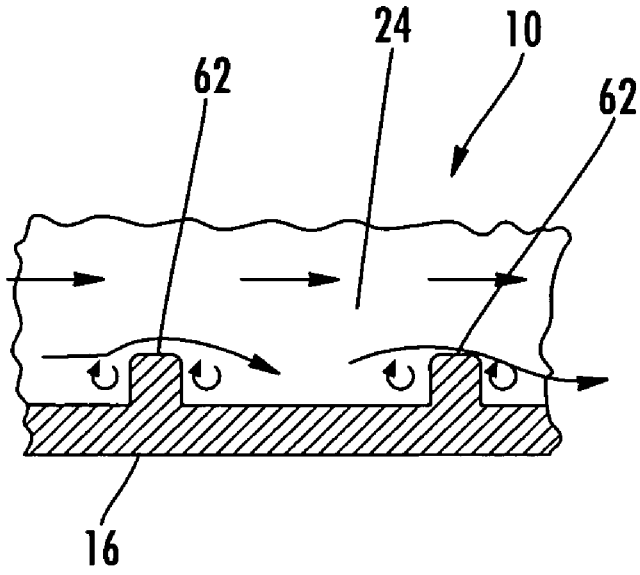
FIG. 8 is a cross-sectional view taken along line 8-8 in FIG. 7.
Figure 9:
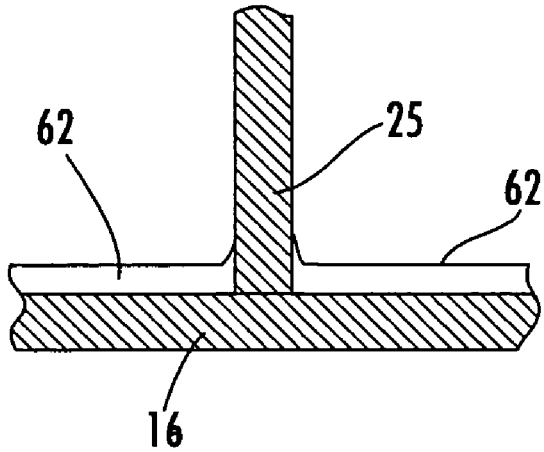
FIG. 9 is a cross-sectional view taken along line 9-9 in FIG. 7.
Figure 10:
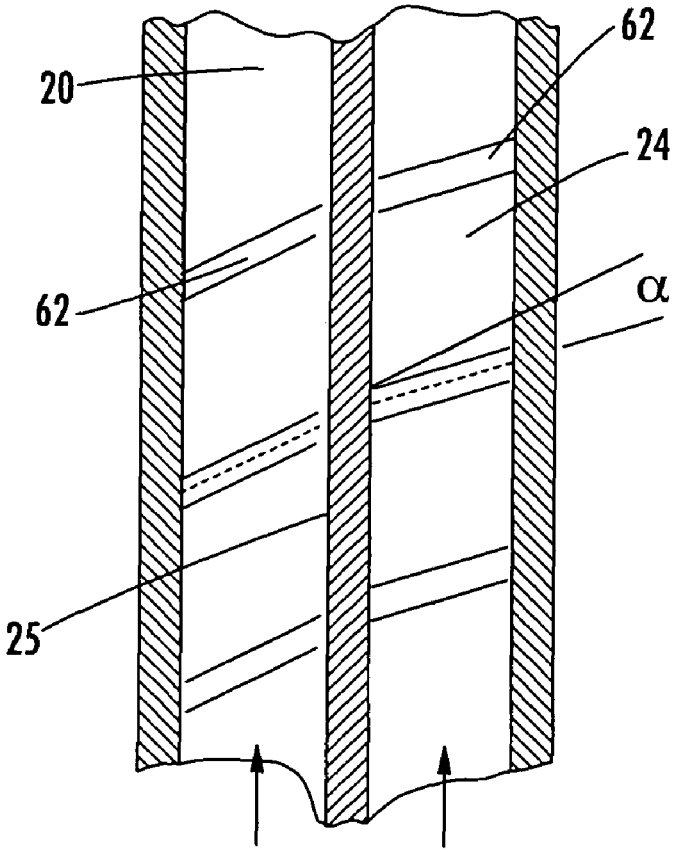
FIG. 10 is a detailed view of an alternative embodiment of the mid-chord feed channel and the trailing edge feed channel taken at line 7-7 in FIG. 4.

As shown in FIGS. 4 and 7-10, the cooling system 10 may include a plurality of trip strips 62. The trip strips 62 may protrude from the outer wall 16 into the cooling system 10, as shown in FIG. 9, to create vortices, as shown in FIG. 8. The trip strips 62 may be positioned in the leading edge cooling channel 54, the mid-chord serpentine channel 18, and the trailing edge region 30. In particular, trip strips 62 may be positioned in the mid-chord feed channel 20 and the trailing edge feed channel 24, as shown in detail in FIG. 7. The trip strips 62 may be positioned at acute angles to the equalizer rib 25. The trip strips 62 in the mid-chord feed channel 20 and the trailing edge feed channel 24 may be aligned with each other, as shown in FIG. 7. The trip strips 62, as shown in FIG. 10, positioned in the mid-chord feed channel 20 may be nonparallel with the trip strips 62 positioned in the trailing edge feed channel 24. In other words, the trip strips 62 in the trailing edge feed channel 24 may be positioned at an acute angle relative to a longitudinal axis of the mid-chord feed channel 20, as shown in FIG. 10.

During use, cooling fluids may be received into the cooling system 10 from a cooling fluid supply through the root 44. The cooling fluids may flow into the mid-chord feed channel 20 and the trailing edge feed channel 24. The cooling fluid flow into the mid-chord feed channel 20 and the trailing edge feed channel 24 may be approximately equal. The cooling fluid flow demand for the airfoil trailing edge 40 is generally much higher than the blade mid-chord region 28 and thus, the cooling fluid is continuously bleed off from the trailing edge feed channel 24. Cooling fluids may flow from the mid-chord feed channel 20 to the trailing edge feed channel 24 to replenish the trailing edge feed channel 24 to maintain an even cooling fluid flow distribution and pressure within both feed channels 20, 24. The replenishment cooling fluids may flow through the supply holes 26 in the equalizer rib 25.

At the upper mid-chord feed channel and the trailing edge feed channel, collectively referred to as a hybrid flow channel, the cooling fluid flow demand in the trailing edge region 30 is less than the mid-chord region 28, and thus, the cooling fluids flow from the trailing edge feed channel 24 to the mid-chord feed channel 20 through the supply holes 26. The cooling fluids therefore replenish the mid-chord feed channel 20.

The cooling fluids flowing into the turbine blade tip section 36 from the trailing edge feed channel 24 impinge on a backside of the tip section 36. The spent cooling fluids may then discharged through the tip cooling orifice 64, the crossover hole 34, and the trailing edge tip exhaust orifice 38. The cooling fluid flowing through the crossover hole 34 flows into the turn in the mid-chord serpentine channel 18 and eliminates the tip corner flow recirculation. The cooling fluid then flows along the tip section 36 to cool the outer wall 16, impinges onto the forward corner of the blade tip section 36 before merging with the cooling fluid flowing from the mid-chord feed channel 20 in the inboard serpentine flow channel 18.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A turbine airfoil, comprising:

a generally elongated, hollow airfoil having a leading edge, a trailing edge, a tip section at a first end, a root coupled to the airfoil at an end generally opposite the first end for supporting the airfoil and for coupling the airfoil to a disc, a platform at an intersection between the root and the generally elongated, hollow airfoil and extending generally orthogonal to a longitudinal axis of the generally elongated, hollow airfoil, and a cooling system formed from a cavity in the elongated, hollow airfoil, the cooling system comprising:

at least one mid-chord feed channel extending in a direction from the root to the tip section;

at least one trailing edge feed channel extending in the direction from the root to the tip section and positioned adjacent to the at least one mid-chord feed channel;

an equalizer rib separating the at least one mid-chord feed channel from the at least one trailing edge feed channel, wherein the equalizer rib includes a plurality of cooling fluid supply holes that place the at least one mid-chord feed channel in fluid communication with the at least one trailing edge feed channel;

wherein the equalizer rib includes a crossover hole positioned at the tip section of the generally elongated, hollow airfoil for placing the at least one mid-chord feed channel in fluid communication with the at least one trailing edge feed channel at the tip section; and a trailing edge tip exhaust channel in fluid communication with the crossover hole and with at least one trailing edge tip exhaust orifice in the trailing edge for exhausting cooling fluids from the trailing edge.

2. The turbine airfoil of claim 1, further comprising a mid-chord serpentine cooling channel, wherein a mid-chord feed channel forms a first outflow channel of the mid-chord serpentine cooling channel.

3. The turbine airfoil of claim 1, wherein the tip section includes a tip cooling orifice aligned with the at least one trailing edge feed channel and in fluid communication with the trailing edge tip exhaust channel.

4. The turbine airfoil of claim 1, further comprising a trailing edge impingement rib extending generally spanwise, positioned between the at least one trailing edge feed channel and the trailing edge, and including a plurality of impingement orifices.

5. The turbine airfoil of claim 1, wherein the cooling fluid supply holes in the equalizer rib have a length to width ratio of between about 2 to 1 and about 5 to 1.

6. The turbine airfoil of claim 5, wherein the length to width ratio of the cooling fluid supply holes in the equalizer rib is about 3.5 to 1.

7. The turbine airfoil of claim 1, wherein the cooling fluid supply holes in the equalizer rib are positioned along the equalizer rib from the root to the tip section.

8. The turbine airfoil of claim 1, further comprising trip strips positioned in the at least one trailing edge feed channel and in the at least one mid-chord feed channel, wherein the trip strips in the at least one trailing edge feed channel are nonparallel with the trip strips in the at least one mid-chord supply channel.

9. A turbine airfoil, comprising:

a generally elongated, hollow airfoil having a leading edge, a trailing edge, a tip section at a first end, a root coupled to the airfoil at an end generally opposite the first end for supporting the airfoil and for coupling the airfoil to a disc, a platform at the intersection between the root and the generally elongated, hollow airfoil and extending generally orthogonal to a longitudinal axis of the generally elongated, hollow airfoil, and a cooling system formed from a cavity in the elongated, hollow airfoil, the cooling system comprising;

a mid-chord serpentine cooling channel positioned in the hollow airfoil and including at least one mid-chord feed channel extending in a direction from the root to the tip section;

at least one trailing edge feed channel extending from the root to the tip section and positioned adjacent to the at least one mid-chord feed channel;

an equalizer rib extending in a spanwise direction and separating the at least one mid-chord feed channel from the at least one trailing edge feed channel, wherein the equalizer rib includes a plurality of cooling fluid supply holes that place the at least one mid-chord feed channel in fluid communication with the at least one trailing edge feed channel;

wherein the equalizer rib includes a crossover hole positioned at the tip section of the generally elongated, hollow airfoil for placing the at least one mid-chord feed channel in fluid communication with the at least one trailing edge feed channel at the tip section; and a trailing edge tip exhaust channel in fluid communication with the crossover hole and with at least one trailing edge tip exhaust orifice in the trailing edge for exhausting cooling fluids from the trailing edge.

10. The turbine airfoil of claim 9, wherein the cooling fluid supply holes in the equalizer rib have a length to width ratio of between about 2 to 1 and about 5 to 1.

11. The turbine airfoil of claim 10, wherein the length to width ratio of the cooling fluid supply holes in the equalizer rib is about 3.5 to 1.

12. The turbine airfoil of claim 10, further comprising a trailing edge impingement rib extending generally spanwise, positioned between the at least one trailing edge feed channel and the trailing edge, and including a plurality of impingement orifices.

13. The turbine airfoil of claim 12, wherein the tip section includes a tip cooling orifice aligned with the at least one trailing edge feed channel and in fluid communication with the trailing edge tip exhaust channel.

14. The turbine airfoil of claim 13, wherein the cooling fluid supply holes in the equalizer rib are positioned along the equalizer rib from the root to the tip section.

15. The turbine airfoil of claim 9, further comprising trip strips positioned in the at least one trailing edge feed channel and in the at least one mid-chord feed channel, wherein the trip strips in the at least one trailing edge feed channel are nonparallel with the trip strips in the at least one mid-chord feed channel.

16. A turbine airfoil, comprising:

a generally elongated, hollow airfoil having a leading edge, a trailing edge, a tip section at a first end, a root coupled to the airfoil at an end generally opposite the first end for supporting the airfoil and for coupling the airfoil to a disc, a platform at the intersection between the root and the generally elongated, hollow airfoil and extending generally orthogonal to a longitudinal axis of the generally elongated, hollow airfoil, and a cooling system formed from a cavity in the elongated, hollow airfoil, the cooling system comprising;

a mid-chord serpentine cooling channel positioned in the hollow airfoil and including at least one mid-chord feed channel extending in a direction from the root to the tip section;

at least one trailing edge feed channel extending from the root to the tip section and positioned adjacent to the at least one mid-chord feed channel;

an equalizer rib extending in a spanwise direction and separating the at least one mid-chord feed channel from the at least one trailing edge feed channel, wherein the equalizer rib includes a plurality of cooling fluid supply holes positioned along the equalizer rib from the root to the tip section that place the at least one mid-chord feed channel in fluid communication with the at least one trailing edge feed channel;

wherein the equalizer rib includes a crossover hole positioned at the tip section of the generally elongated, hollow airfoil for placing the at least one mid-chord feed channel in fluid communication with the at least one trailing edge feed channel at the tip section;

a trailing edge tip exhaust channel in fluid communication with the crossover hole and with at least one trailing edge tip exhaust orifice in the trailing edge for exhausting cooling fluids from the trailing edge; and a trailing edge impingement rib extending generally spanwise, positioned between the trailing edge feed channel and the trailing edge, and including a plurality of impingement orifices.

17. The turbine airfoil of claim 16, wherein the cooling fluid supply holes in the equalizer rib have a length to width ratio of between about 2 to 1 and about 5 to 1.

18. The turbine airfoil of claim 17, wherein the length to width ratio of the cooling fluid supply holes in the equalizer rib is about 3.5 to 1.

19. The turbine airfoil of claim 16, wherein the tip section includes a tip cooling orifice aligned with the at least one trailing edge feed channel and in fluid communication with the trailing edge tip exhaust channel.

20. The turbine airfoil of claim 16, further comprising trip strips positioned in the at least one trailing edge feed channel and in the at least one mid-chord feed channel, wherein the trip strips in the at least one trailing edge feed channel are nonparallel with the trip strips in the at least one mid-chord feed channel.

* * * * *